US011702933B2

(12) United States Patent
Cui et al.

(10) Patent No.: US 11,702,933 B2
(45) Date of Patent: Jul. 18, 2023

(54) METHOD FOR DETERMINING VERTICAL WELL STRATIFIED FRACTURING CRACK LENGTHS BASED ON INTERLAYER EQUILIBRIUM DISPLACEMENT

(71) Applicants: China University of Petroleum (East China), Qingdao (CN); Research Institute of Exploration and Development, Shengli Oilfield Branch, Sinopec, Dongying (CN)

(72) Inventors: Chuanzhi Cui, Qingdao (CN); Zhongwei Wu, Qingdao (CN); Zhen Wang, Qingdao (CN); Tongyu Yao, Qingdao (CN); Chuanbao Zhang, Dongying (CN); Guangzhong Lv, Dongying (CN); Yongpeng Ren, Dongying (CN); Gang Cao, Dongying (CN); Xiaoduo Cui, Dongying (CN); Bo Chen, Qingdao (CN)

(73) Assignees: China University of Petroleum (East China), Qingdao (CN); Research Institute of Exploration and Development, Shengli Oilfield Branch, Sinopec, Dongying (CN)

( * ) Notice: Subject to any disclaimer, the term of this patent is extended or adjusted under 35 U.S.C. 154(b) by 533 days.

(21) Appl. No.: 16/821,148

(22) Filed: Mar. 17, 2020

(65) Prior Publication Data

US 2020/0392842 A1 Dec. 17, 2020

(30) Foreign Application Priority Data

Jun. 14, 2019 (CN) ..... 201910515902.1

(51) Int. Cl.
*E21B 43/26* (2006.01)
*E21B 47/06* (2012.01)
(Continued)

(52) U.S. Cl.
CPC ..... *E21B 49/008* (2013.01); *E21B 43/26* (2013.01); *E21B 47/06* (2013.01); *E21B 47/08* (2013.01)

(58) Field of Classification Search
CPC ..... E21B 49/008; E21B 43/26; E21B 47/06; E21B 47/08
See application file for complete search history.

(56) References Cited

U.S. PATENT DOCUMENTS 8,776,914 B2 * 7/2014 Demichel ..... E21B 43/32 166/50
2014/0083687 A1 * 3/2014 Poe ..... E21B 43/26 166/250.1

OTHER PUBLICATIONS

"Al-Obaidi, Induced Fractures Modelling in Reservoir Dynamic Simulators (and Optimum Hydraulic Fracture Dimensions/ Modelling), 2015, pp. 12-17" (Year: 2015).*

(Continued)

*Primary Examiner* — Mohamed Charioui
(74) *Attorney, Agent, or Firm* — Flener IP & Business Law; Zareefa B. Flener

(57) ABSTRACT

The invention discloses a method for determining vertical well stratified fracturing crack length based on interlayer equilibrium development. According to the method, interlayer equilibrium development can be achieved by determining the crack length of fracturing of each layer in the condition that an oil well meets the productivity requirements. The method comprises the following steps: 1) a threshold pressure gradient of each layer is determined; 2) a relationship chart of the crack half-length $x_f$ and the equivalent well diameter $r_{we}$ is established; 3) daily oil production rate per unit thickness $Q_c$ meeting the production requirements is calculated; 4) the equivalent well diameter $r_{we}$ of each layer is calculated according to the daily oil production rate $Q_c$; and 5) the crack half-length $x_f$ of fracturing of each (Continued)

layer is calculated according to the equivalent well diameter $r_{we}$ of each layer.

4 Claims, 1 Drawing Sheet

(51) Int. Cl.
*E21B 47/08* (2012.01)
*E21B 49/00* (2006.01)

(56) References Cited

OTHER PUBLICATIONS

Zoback et al. "The Effect of Microcrack Dilatancy on Permeability of Westerly Granite", Feb. 10, 1975, Journal of Geophysical Research, vol. 80, pp. 752-755. (Year: 1975).*

* cited by examiner

METHOD FOR DETERMINING VERTICAL WELL STRATIFIED FRACTURING CRACK LENGTHS BASED ON INTERLAYER EQUILIBRIUM DISPLACEMENT

TECHNICAL FIELD

The invention relates to the field of improving fracturing in tight reservoirs, in particular to a method for determining vertical well stratified fracturing crack lengths based on interlayer equilibrium displacement.

BACKGROUND

Development of tight reservoirs is a new hotspot of unconventional oil and gas exploration and development in the world, which is usually focused on fracturing development. Due to the influence of reservoir physical property differences between layers of tight reservoirs, interlayer production rates vary greatly and interlayer contradictions are prominent. It is an effective method of decreasing the interlayer contradictions by designing appropriate vertical well stratified fracturing crack lengths according to the differences of interlayer reservoir physical properties. With the goal of interlayer equilibrium displacement, by comprehensively optimizing a crack length in the fracturing of each section of layers, all layers can be effectively developed and oil recovery can be improved.

SUMMARY

In view of this, the invention provides a method for determining vertical well stratified fracturing crack lengths based on interlayer equilibrium displacement, so that all layers can be effectively developed and equilibrium displacement between each layer can be realized.

For a vertical well stratified fracturing well group, in the condition of n layers commingled production, for each layer with permeability of $k_i$ porosity of $\Phi_i$, oil viscosity of $\mu_i$, and a thickness of $h_i$, stratified fracturing is conducted for oil wells. A length of each layer fracture is $x_{fi}$, and injection-production pressure difference is $\Delta P$. In order to obtain a high fracturing oil well productivity $Q_o$, the optimization of crack half-length $x_f$ developing in each layer is conducted based on interlayer equilibrium development.

The invention can be realized through the following steps:

step 1, determining a threshold pressure gradient of each layer, step 2, establishing a relationship chart between the crack half-lengths $x_f$ and equivalent well diameters $r_{we}$, step 3, calculating daily oil production rate per unit thickness $Q_c$ that meets production requirements, step 4, calculating the equivalent well diameter $r_{we}$ of each layer according to the daily oil production rate per unit thickness $Q_c$, step 5, calculating the crack half-length $x_f$ according to the equivalent well diameter $r_{we}$.

Optionally, a specific calculation formula for determining the threshold pressure gradient of each layer in the step 1 is as follows:

$$\lambda = \frac{0.0031\mu}{K} \tag{1}$$

where, $\lambda$ is the threshold pressure gradient in MPa/m; $\mu$ is oil viscosity in mPa·s; K is formation permeability in $\mu m^2$;

Optionally, steps for establishing the relationship chart between the crack half-lengths $x_f$ and the equivalent well diameters $r_{we}$ in the step 2 is as follows:

A formula for calculating an equivalent well diameter of a vertical fractured well with finite conductivity is:

$$\frac{r_{we}}{x_f} = e^{-F} \tag{2}$$

$$\text{where, } F = \frac{1.65 - 0.328u + 0.116u^2}{1 + 0.18u + 0.064u^2 + 0.005u^3},$$

$$u = \ln(C_{fD}),$$

$$C_{fD} = \frac{k_f \cdot w_f}{k \cdot x_f},$$

$r_{we}$ is the equivalent well diameter in meters; $x_f$ is the crack half-length in meters; $C_{fD}$ is crack dimensionless conductivity; $w_f$ is a crack half-width in meters; $k_f$ is crack permeability in $\mu m^2$;

The relationship chart between the crack half-lengths $x_f$ and the equivalent well diameters $r_{we}$ can be obtained by Eq.(2) when many crack dimensionless conductivities $C_{fD}$ are taken.

Optionally, the specific steps for calculating the daily oil production rate per unit thickness $Q_c$ that meets the production requirements in the step 3 are as follows:

In order to obtain a high fracturing well production rate $Q_o$ and realize interlayer equilibrium development, which is corresponding to that the daily oil production rate per unit thickness $Q_c$ of each layer is the same, a relationship between the daily oil production rate per unit thickness $Q_c$ of each layer and the production rate $Q_i$ of each layer is as follows, $$Q_c = \frac{Q_0}{H} = \frac{Q_1}{h_1} = \ldots = \frac{Q_n}{h_n} \tag{3}$$

where, the daily oil production rate per unit thickness $Q_c$ being in $m^3/(d \cdot m)$; the daily oil production rate $Q_0$ after production of the fractured oil well being in $m^3/d$; the daily oil production rate $Q_i$ of each layer being in $m^3/d$; and H is a total thickness of oil reservoirs in meters;

Optionally, in the step 4, a specific calculation formula for calculating the equivalent well diameter $r_{we}$ of each layer according to the daily oil production rate $Q_c$, is as follows:

$$r_{we} = Le\left[\frac{115.7 \times 2\pi k(\lambda L - \Delta P)}{Q_c \mu}\right] \tag{4}$$

where, L is an injection-production well spacing in meters; k is formation permeability in $\mu m^2$; $\Delta P$ is an injection and production pressure difference in MPa; $\mu$ is oil viscosity in mPa·s;

Optionally, specific steps for calculating crack half-length $x_f$ according to the equivalent well diameter $r_{we}$ in the step 5 are as follows:

knowing the crack dimensionless conductivity $C_{fD}$ in a layer, according to the relationship chart between the crack half-lengths $x_f$ and the equivalent well diameters $r_{we}$ established in the step 2, a ratio of the equivalent well diameter $r_{we}$ of the layer to the crack half-length $x_f$ can be found in the chart, and thus the crack half-length $x_f$ in the layer is obtained according to the equivalent well diameter $r_{we}$ calculated in step 5.

DETAILED DESCRIPTION

The technical solution of the invention is further described in detail in combination with specific embodiments in the following.

Taking a low permeability reservoir as an example, its block has 5 layers, and the basic parameters are set as shown in Table 1:

TABLE 1

Statistics Table of Each Layer

| Layer number | 1 | 2 | 3 | 4 | 5 |
|---|---|---|---|---|---|
| Permeability/$10^{-3}$ μm$^2$ | 5.12 | 4.25 | 3.58 | 2.48 | 1.08 |
| Viscosity/mPa · s | 1.41 | 1.41 | 1.40 | 1.40 | 1.40 |
| Thickness/m | 2.0 | 1.8 | 3.5 | 4.1 | 2.5 |

According to the above parameters, calculation can be made. The specific implementation steps are as follows.

Step 1: determining a threshold pressure gradient of each layer. The threshold pressure gradient of layer 1 is:

$$\lambda_1 = \frac{0.0031\mu_1}{K_1} = \frac{0.0031 \times 1.41}{5.12 \times 10^{-3}} = 0.854(MPa/\text{m});$$

Similarly, the threshold pressure gradient of other layers can also be obtained.

Step 2: establishing a relationship chart between the crack half-lengths $x_f$ and the equivalent well diameters $r_{we}$. When the crack dimensionless conductivity $C_{fD}$=1, the relationship between the equivalent well diameters and the crack half-lengths can be obtained from the formula (2), that is, $$\frac{r_{we}}{X_f} = e^{-F} = 0.192.$$

Figure 1:
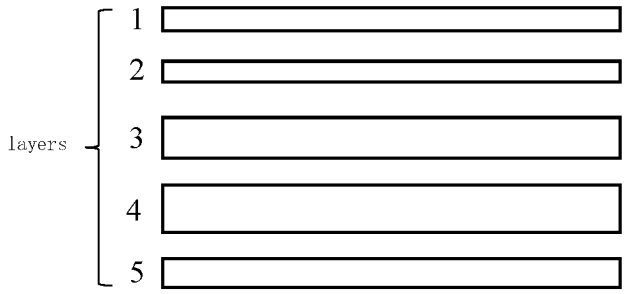
FIG. 1 is a layer diagram of a method for determining vertical well stratified fracturing crack lengths based on interlayer equilibrium development according to the present invention.
Figure 2:
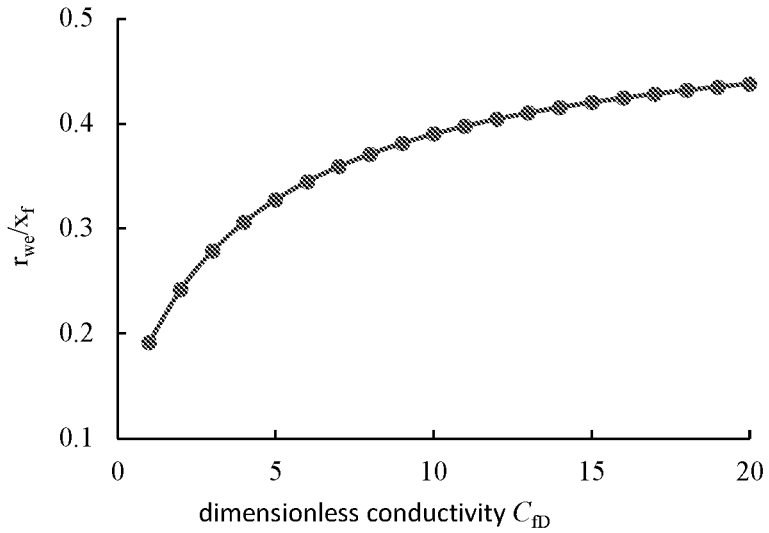
FIG. 2 is a relationship graph between equivalent well diameters and crack dimensionless conductivity according to the present invention.

Similarly, a ratio between the equivalent well diameter and the crack half-length under different crack dimensionless conductivity can be obtained (see FIG. 2).

Step 3: calculating daily oil production per unit thickness $Q_c$ that meets the production requirements. In order to obtain a high fracturing well production rate $Q_o$=10 m$^3$/d and realize interlayer equilibrium development, which is corresponding that the production rate per unit thickness $Q_c$ of each layer is the same, the daily oil production per unit thickness can be obtained by formula (3), $$Q_c = \frac{Q_0}{H} = \frac{Q_1}{h_1} = \ldots = \frac{Q_n}{h_n} = 0.72\text{m}^3/(d \cdot \text{m}).$$

Step 4: calculating the equivalent well diameter $r_{we}$ of each layer according to the daily oil production $Q_c$. The equivalent well diameter of layer 1 is $$r_{we} = Le\left[\frac{115.7 \times 2\pi k(\lambda L - \Delta P)}{Q_c \mu}\right] = 19.4\text{m}.$$

Similarly, the equivalent well diameters of other layers can be obtained, seeing Table 2.

Step 5: calculating the crack half-length $x_f$ according to the equivalent well diameter $r_{we}$.

Knowing the crack dimensionless conductivity of the layer $C_{fD}$=1, by looking up the relationship chart between the crack half-lengths $x_f$ and the equivalent well diameters $r_{we}$ established in step 2, it can be obtained that $r_{we}/x_f$=0.192, when $C_{fD}$=1. Furthermore, the crack half-length $x_f$=101 m of the layer can be obtained according the equivalent well diameter $r_{we}$=19.4 calculated in step 4. Similarly, the crack half-length of other layers that can achieve equilibrium development and meet the production capacity requirements after fracturing production can be obtained, seeing Table 2.

TABLE 2

Data of Each Layer and Crack Half-Length

| Layer number | 1 | 2 | 3 | 4 | 5 |
|---|---|---|---|---|---|
| Permeability/$10^{-3}$ μm$^2$ | 5.12 | 4.25 | 3.58 | 2.48 | 1.08 |
| Viscosity/mPa · s | 1.41 | 1.41 | 1.40 | 1.40 | 1.40 |
| Thickness/m | 2.0 | 1.8 | 3.5 | 4.1 | 2.5 |
| Equivalent well diameter/m | 19.4 | 20.5 | 21.1 | 22.7 | 24.0 |
| Crack half-length/m | 91 | 102 | 110 | 121 | 135 |

The above calculation results were verified using reservoir numerical simulation technology. Based on the data in Table 1, a five-point well group (four injections and one production) model was established to fracture the oil wells. There are two cases for comparison: one is general fracturing, that is, the crack length of each layer fracturing is the same, and the other is stratified fracturing, that is, the crack length of each layer adopts the calculation results in Table 2. The recovery percent of each layer after 5 years of production is shown in table 3. It can be seen that in the case of general fracturing, the maximum recovery percent of each layer is 9.55%, while the minimum is 3.32%. In the case of performing stratified fracturing using the calculated results herein, the difference between the maximum recovery percent and the minimum recovery percent is only 0.28%, and the difference between the interlayer recovery percents is very small, which effectively reduces the interlayer contradiction and achieves good effects.

TABLE 3

Comparison of Recovery Percent of Each Layer

| Layer number | 1 | 2 | 3 | 4 | 5 |
|---|---|---|---|---|---|
| Each layer has the same fracturing crack length, % | 9.55 | 7.68 | 6.73 | 4.85 | 3.32 |
| Stratified fracturing according to calculation results, % | 7.78 | 7.75 | 7.63 | 7.52 | 7.50 |

What is claimed is:

1. A method for determining vertical well stratified fracturing crack lengths based on interlayer equilibrium development, characterized in that, comprising the following steps:

step 1: determining a threshold pressure gradient of each layer, step 2: establishing a relationship chart between crack half-lengths $x_f$ and equivalent well diameters $r_{we}$, step 3: calculating daily oil production rate per unit thickness $Q_c$ that meets production requirements, step 4: calculating the equivalent well diameter $r_{we}$ of each layer according to the daily oil production rate per unit thickness $Q_c$, step 5: calculating the crack half-length $x_f$ of each fracturing layer according to the equivalent well diameter $r_{we}$ of each layer;

step 6: performing stratified fracturing according to the crack half-length $x_f$ of each fracturing layer;

wherein a calculation formula for determining the threshold pressure gradient of each layer in the step 1 is as follows:

$$\lambda = \frac{0.0031\mu}{K}$$

where, λ is the threshold pressure gradient in MPa/m; μ is oil viscosity in mPa·s; k is formation permeability in μm $^2$;

wherein steps for calculating the daily oil production rate per unit thickness $Q_c$ that meets the production requirements in the step 3 are as follows:

in order to obtain a high fracturing well daily oil production rate $Q_o$ and realize the interlayer equilibrium development, which is corresponding to that the daily production rate per unit thickness $Q_c$ of each layer is the same, a relationship between $Q_c$, the daily oil production rate $Q_o$ after a fractured oil well products and daily oil production rate $Q_i$ of each layer is as follows:

$$Q_c = \frac{Q_0}{H} = \frac{Q_1}{h_1} = \ldots = \frac{Q_n}{h_n}$$

where, $Q_c$, is the daily oil production rate per unit thickness in $m^3/(d\cdot m)$; $Q_o$ is the daily oil production rate after the fractured oil well products in $m^3/d$; $Q_i$ is the daily oil production rate of each layer in $m^3/d$; H is a total thickness of oil reservoirs in meters; and $h_i$ is a thickness of each layer in meters.

2. The method according to claim 1, wherein steps for establishing the relationship chart between the crack half-lengths $x_f$ and the equivalent well diameters $r_{we}$ in the step 2 is as follows:

a formula for calculating an equivalent well diameter of a vertical fractured well with finite conductivity is:

$$\frac{r_{we}}{x_f} = e^{-F}$$

where, $$F = \frac{1.65 - 0.328u + 0.116u^2}{1 + 0.18u + 0.064u^2 + 0.005u^3},$$

$$u = \ln(C_{fD}),$$

$$C_{fD} = \frac{k_f \cdot w_f}{k \cdot x_f};$$

$r_{we}$ is the equivalent well diameter in meters; $x_f$ is the crack half-length in meters; $C_{fD}$ is the crack dimensionless conductivity; $w_f$ is the crack half-width in meters; and $k_f$ is the crack permeability in μm$^2$;

the relationship chart between the crack half-lengths $x_f$ and the equivalent well diameters $r_{we}$ is obtained when many crack dimensionless conductivities $C_{fD}$ are given.

3. The method according to claim 1, wherein a calculation formula for calculating the equivalent well diameter $r_{we}$ of each layer according to the daily oil production rate $Q_c$ in the step 4 is:

$$r_{we} = Le^{\left[\frac{115.7\times 2\pi k(\lambda L - \Delta P)}{Q_c \mu}\right]}$$

where, L is an injection-production well spacing in meters; k is formation permeability in μm$^2$; ΔP is an injection and production pressure difference in MPa; μ is oil viscosity in mPa·s; and λ is the threshold pressure gradient in MPa/m.

4. The method according to claim 1, wherein steps for calculating the crack half-length $x_f$ according to the equivalent well diameter $r_{we}$ in the step 5 are as follows:

knowing a crack dimensionless conductivity $C_{fD}$ in a layer, according to the relationship chart between the crack half-lengths $x_f$ and the equivalent well diameters $r_{we}$ established in the step 2, a ratio of the equivalent well diameter $r_{we}$ of the layer to the crack half-length $x_f$ is found in the chart, and thus the crack half-length $x_f$ in the layer is obtained according to the equivalent well diameter $r_{we}$ calculated in the step 5.

* * * * *